United States Patent [19]

Da Fonte, Jr.

[11] 4,359,346

[45] Nov. 16, 1982

[54] TRIVALENT CHROMIUM PASSIVATE SOLUTION AND PROCESS FOR YELLOW PASSIVATE FILM

[75] Inventor: Bento Da Fonte, Jr., Mt. Clemens, Mich.

[73] Assignee: Occidental Chemical Corporation, Warren, Mich.

[21] Appl. No.: 254,700

[22] Filed: Apr. 16, 1981

[51] Int. Cl.[3] ..... C23F 9/00; C23F 7/26

[52] U.S. Cl. ..... 148/6.2; 148/6.21

[58] Field of Search ..... 148/6.2, 6.21

[56] References Cited

U.S. PATENT DOCUMENTS 4,171,231 10/1979 Bishop et al. ..... 148/6.21

*Primary Examiner*—James R. Hoffman

*Attorney, Agent, or Firm*—Richard P. Mueller

[57] ABSTRACT

An aqueous acidic solution and process for treating receptive metal surfaces, particularly zinc and zinc alloy surfaces, to impart a light-yellow iridescent passivate film thereon imparting improved corrosion resistance thereto. The aqueous solution contains effective amounts of chromium ions substantially all of which are in the trivalent state, hydrogen ions to provide a pH of about 1.2 to about 2.5, an oxidizing agent and cerium ions present in an amount effective to activate the bath and promote the formation of a light-yellow passivate film on the metal substrate. The treating solution may optionally further contain halide ions, a wetting agent and additional metal ions selected from the group consisting of iron, cobalt, nickel, molybdenum, manganese, lanthanum, lanthanide mixtures of rare earth oxides as well as mixtures thereof.

32 Claims, No Drawings

TRIVALENT CHROMIUM PASSIVATE SOLUTION AND PROCESS FOR YELLOW PASSIVATE FILM

BACKGROUND OF THE INVENTION

A variety of chromium containing aqueous solutions have heretofore been used or proposed for treating zinc, zinc alloy, cadmium, cadmium alloy and aluminum surfaces for improving the corrosion resistance properties thereof. Such treating solutions originally contained chromium in the hexavalent state and in more recent years the chromium constituent was present as a mixture of the hexavalent and trivalent forms. The reduced toxicity of trivalent chromium and the increased simplicity and efficiency in treating waste effluents containing trivalent chromium has occasioned an increased commercial use of passivate solutions in which the chromium constituent is substantially entirely in the trivalent state. Such prior trivalent chromium passivating solutions have been found to be somewhat less effective than the traditional hexavalent chromium passivating solutions in imparting good corrosion resistance to zinc, cadmium and aluminum surfaces as well as alloys thereof and there has, accordingly, been a continuing need for further improvement in trivalent chromium passivating solutions and processes.

The excellent corrosion protection provided by hexavalent chromium passivating solutions is generally associated with a light yellow iridescent passivate film which has been recognized and embodied in ASTM specifications. Conventionally, trivalent chromium passivate films are of a clear to light-blue color and are of inferior corrosion protection than the yellow hexavalent passivate film. This problem has been further aggravated by a conversion from conventional cyanide zinc and cadmium plating processes to acid and alkaline non-cyanide electroplating baths which produce metal deposits which are not as receptive to chromium passivate treatments.

Typical of prior art compositions and processes for treating metal surfaces are those disclosed in U.S. Pat. Nos. 2,393,663; 2,559,878; 3,090,710; 3,553,034; 3,755,018; 3,795,549; 3,880,772; 3,932,198; 4,126,490; 4,171,231; British Pat. Nos. 586,517 and 1,461,244; and German Pat. No. 2,526,832.

The present invention provides a treating solution and process which is effective to impart a clear light-yellow passivate film to zinc, zinc alloy, cadmium, cadmium alloy, aluminum and magnesium surfaces which provides for improved corrosion resistance approaching or comparable to that heretofore obtained employing conventional hexavalent chromium passivating solutions. The present invention is further characterized by a process which is simple to control and operate and which is of efficient and economical operation.

SUMMARY OF THE INVENTION

The benefits and advantages of the present invention are achieved in accordance with the composition aspects thereof by providing an aqueous acidic treating solution containing as its essential constituents, chromiun ions substantially all of which are present in the trivalent state at a concentration of from about 0.05 grams per liter (g/l) up to saturation, hydrogen ions to provide a solution pH of about 1.2 to about 2.5 which can be conveniently introduced by mineral acids such as sulfuric acid, nitric acid, hydrochloric acid or the like; an oxidizing agent of which hydrogen peroxide itself is preferred present in an amount of about 1 to about 20 g/l, and cerium ions present in an amount effective to activate the bath and the formation of a clear light-yellow chromium passivate film on the treated substrate. In addition to the cerium ions in the treating solution, the solution may optionally and preferably further contain an additional metal ion selected from the group consisting of iron, cobalt, nickel, molybdenum, manganese, lanthanum, lanthanide mixtures as well as mixtures thereof to provide a further activation of the bath and passivate film formation. The solution may optionally also contain halide ions for imparting hardness to the coating in addition to a small amount of a wetting agent.

In accordance with the process aspects of the present invention, zinc, cadmium, zinc alloy, cadmium alloy, aluminum and magnesium surfaces are contacted with the aqueous acidic treating solution at a temperature ranging from about 40° up to about 150° F. for a period of time typically ranging from about 10 seconds up to about 1 minute to form the desired passivate film.

Additional benefits and advantages will become apparent on a reading of the Description of the Preferred Embodiments taken in conjunction with the specific examples provided.

DESCRIPTION OF THE PREFERRED EMBODIMENTS

The present invention is particularly applicable but not limited to the treatment of alkaline and acidic non-cyanide zinc and cadmium electrodeposits to impart improved corrosion resistance thereto. Particularly satisfactory results are obtained on decorative zinc and cadmium electrodeposits of the bright and semi-bright types although beneficial effects are also achieved on zinc and zinc alloy substrates such as galvanized substrates, zinc die castings and substrates comprised of cadmium or alloys of cadmium predominantly comprised of cadmium. While the invention as herein described is particularly directed to the treatment of zinc and zinc alloy surfaces, it has been observed that beneficial results are also obtained in the treatment of aluminum, aluminum alloy, magnesium and magnesium alloy surfaces to form a passivate film or coating thereon. Accordingly, the present invention in its broad sense is directed to the treatment of metal surfaces which are receptive to the formation of a passivate film thereon when contacted with the solution of the present invention in accordance with the process parameters disclosed.

In accordance with the present invention, the treating solution contains as its essential constituents, chromium ions which are present substantially all in the trivalent state, hydrogen ions to provide a pH of from about 1.2 to about 2.5, an oxidizing agent in an amount effective to activate the hydrated trivalent chromium to form a chromate film on the metal surface, and cerium ions present in an amount effective to impart integral hardness to the gelatinous chromate film. The treating solution may optionally further contain one or more additional metal ions selected from the group consisting of iron, cobalt, nickel, molybdenum, manganese, lanthanum, lanthanide mixtures of rare earth metals and mixtures thereof in an amount effective to further activate the bath and the formation of the chromate passivate film. Additionally, the treating solution may optionally further contain halide ions including fluoride, chloride and bromide ions for increasing the hardness of the passivate film as well as one or more compatible wetting agents for achieving efficient contact with the substrate being treated.

The trivalent chromium ions can be introduced in the form of any bath soluble and compatible salt such as chromium sulfate [$Cr_2(SO_4)_3$], chromium alum [$KCr(SO_4)_2$], chromium chloride [$CrCl_3$], chromium bromide [$CrBr_3$], chromium fluoride [$CrF_3$], chromium nitrate $Cr(NO_3)_3$, or the like. The trivalent chromium ions can also be introduced by a reduction of a solution containing hexavalent chromium ions employing an appropriate reducing agent of any of the types well known in the art to effect a substantially complete stoichiometric reduction of all of the hexavalent chromium to the trivalent state.

The concentration of the trivalent chromium ions in the treating solution may range from as low as about 0.05 g/l up to saturation with quantities of about 0.2 to 2 g/l being preferred. Typically, the operating bath contains from about 0.5 to about 1 g/l trivalent chromium ions.

The treating bath contains hydrogen ions in an amount to provide a pH of about 1.2 to about 2.5 with a pH range of about 1.5 to about 2.0 being preferred. Acidification of the operating bath to within the desired pH range can be achieved by a variety of mineral acids and organic acids such as sulfuric acid, nitric acid, hydrochloric acid, formic acid, acetic acid, propionic acid and the like of which sulfuric acid and nitric acid are preferred. The presence of sulfate ions in the bath has been found beneficial in achieving the desired passivation of the substrate and can be introduced by the sulfuric acid addition or sulfate salts of the other bath constituents. Sulfate ion concentrations can range in amounts up to about 15 g/l with concentrations of from about 0.5 to about 5 g/l being preferred.

The treating bath further contains an oxidizing agent or agents which are bath compatible of which peroxides including hydrogen peroxide and metal peroxides such as the alkali metal peroxides are preferred. Hydrogen peroxide itself of a commercial grade containing about 25% to 60% by volume peroxide constitutes the preferred material. Other peroxides that can be employed include zinc peroxide. Additionally, ammonium and alkali metal persulfates have also been found effective as oxidizing agents.

The concentration of the oxidizing agent or mixture of oxidizing agents is controlled to achieve the desired surface appearance of the treated substrate which preferably is of a light, iridescent-yellow appearance. Typically, the concentration of the oxidizing agent can range from about 1 to about 20 g/l with an amount of about 3 to about 7 g/l being preferred, calculated on a weight equivalent effectiveness basis to hydrogen peroxide.

A further essential constituent of the treating bath comprises cerium ions present in an amount effective to activate the bath and to impart a clear yellowish color, preferably an iridescent light-yellow color to the passivate film on the substrate treated. The cerium ions can be introduced in the form of any bath soluble and compatible cerium salt including cerium sulfate [Ce(SOHD 4)$_2$.4$H_2O$]; halide salts such as cerous chloride [$CeCl_3$.6-$H_2O$]; nitrate salts such as cerium nitrate [$Ce(NO_3)$.5-$H_2O$], [$Ce(NO_3)_3(OH)$.3$H_2$0] and the like. Usually, at least some of the cerium ions are introduced into the bath in the tetravalent state to impart the characteristic yellow color of the tetravalent cerium ion into the passivate film. Certain oxidizing agents such as hydrogen peroxide, act as a reducing agent under the acid conditions prevalent in the bulk of the operating bath and reduce some of the tetravalent cerium ions to the trivalent state. However, oxidizing agents such as hydrogen peroxide revert from a reducing agent to an oxidizing agent at the interface of the substrate being treated due to the higher pH prevalent at the interface and oxidize at least some of the trivalent cerium ions to the tetravalent state which are deposited in the film and impart the characteristic yellow color thereto. When using such oxidizing agents as hydrogen peroxide, accordingly, all of the cerium ions can, if desired, be initially introduced into the operating bath in the trivalent state of which a portion are oxidized to the tetravalent state at the interface of the substrate. The passivate film usually contains a mixture of trivalent and tetravalent cerium compounds and the intensity of the yellow color of the film is dictated by the concentration of tetravalent cerium compounds present. The cerium sulfate compound, due to solubility difficulties, is preferably added to the bath in the form of an acid solution such as a sulfuric acid solution containing the cerium sulfate dissolved therein.

The concentration of cerium ions in the operating bath can range from about 0.5 up to about 10 g/l with concentrations of from about 1.0 to about 4.0 g/l being preferred. The concentration of cerium ions is in part influenced by the magnitude of the yellow coating desired and higher concentrations of the cerium ions produce corresponding increases in the yellow color of the passivate film.

Because of cost considerations, the cerium ions are preferably introduced as a commercially available mixture of rare earth salts of metals in the lanthanide series which contains cerium compounds as the principal component. One such commercially available material is a cerous chloride solution containing about 46% solids of which $CeCl_3.6H_2O$ predominates. The cerous chloride solution is derived from a rare earth oxide (REO) concentrate sold by Molycorp, Inc. of White Plains, New York under produce code 5310 containing a minimum of 99 percent total REO of which $CeO_2$ is 96%; $La_2O_3$ is 2.7%, $Nd_2O_3$ is 1% and $Pr_6O_{11}$ is 0.3%. A ceric sulfate solution is commercially available from the same source containing about 42% solids of which $Ce(SO_4)_2.H_2O$ predominates and which is also prepared from product code 5310 containing other rare earth metal compounds in similar minor amounts.

In addition to the cerium ions, the bath may further optionally and preferably contain at least one additional metal ion selected from the group consisting of iron, cobalt, nickel, molybdenum, manganese, lanthanum, lanthanide mixtures as well as mixtures thereof. For economic reasons, the lanthanum ions are introduced not as a pure lanthanum compound, but as a mixture of the rare earth salts of the metals of the lanthanide series, (hereinafter designated as "lanthanide mixture") which contains lanthanum compounds as the predominant constituent. A commercially available lanthanide mixture which is suitable for use in the practice of the present invention is Lanthanum—Rare Earth Chloride, product code 5240, available from Molycorp, Inc. of White Plains, New York. This product has the general formula La—$RECl_3.6H_2O$ and is available as a solution containing about 55 to 60% by weight solids. The solution is prepared from a rare earth oxide (REO) concentrate containing a minimum of 46% total REO comprising about 60% lanthanum oxide ($La_2O_3$), 21.5% neodymium oxide ($Nd_2O_3$), 10% cerium oxide ($CeO_2$), 7.5% praseodymium oxide ($Pr_6O_{11}$) and 1% of residual REO. The use of this material also contributes to the addition of a small portion of the essential cerium ions. The presence of the remaining rare earth metals in the solution does not appear to have any adverse effect at the low concentrations in which they are present and may further contribute to the activation of the treating solution in forming the passivate film.

The foregoing metal ions or mixtures of metal ions are conveniently introduced as in the case of the cerium ions, by way of bath soluble and compatible metal salts including the sulfates, nitrates, halide salts, or the like. The concentration of the additional metal ions for appropriate activation of the treating bath is controlled to provide a concentration ranging up to about 1 g/l with concentrations of from about 0.1 to about 0.2 g/l being typical.

As an optional but preferred constituent, the bath contains halide ions including chlorine, bromine and fluorine ions which have been found to enhance the hardness of the passivate film on the treated substrate. The halide ions or mixtures thereof can conveniently be introduced employing any of the alkali metal and ammonium salts thereof as well as salts of the metal ions hereinabove set forth. The concentration of the total halide constituent in the bath normally may range up to about 8 grams per liter with concentrations of about 0.1 to about 2.5 g/l being typical.

In addition to the foregoing, the use of a small effective amount of a variety of bath compatible wetting agents also provides beneficial results in the nature of the passivate film deposited. When employed, the wetting agent can be present in concentrations up to about 1 g/l with concentrations of about 50 to about 100 mg/l being preferred.

Wetting agents suitable for use in the treating bath include aliphatic fluorocarbon sulfonates available from 3M under the Fluorad brandname, such as, for example, Fluorad FC 98, which is a non-foaming wetting agent and its use at about 100 mg/l in the working bath improves the color and hardness of the passivate film. A second class of suitable wetting agents is the sulfo derivatives of succinates. An example of this class is Aerosol MA-80 which is dihexyl ester of sodium sulfosuccinic acid and is commercially available from American Cyanamid Company. A third class of suitable wetting agents is the sulfonates of naphthalene which are linear alkyl naphthalene sulfonates, such as Petro BA, for example, available from Petrochemical Company.

In accordance with the process aspects of the present invention, a treating bath formulation as hereinabove described is applied to a substrate to be treated by spray, immersion, flooding or the like for a period of time sufficient to form the desired passivate film thereon. The treating solution is controlled within a temperature range of about 40° to about 150° F., with a temperature range of about 70° to about 90° F. being preferred. Temperatures above about 90° F. have a tendency to cause a rapid loss of the peroxide-type oxidizing agents when used whereas temperatures below about 70° F. reduce the activity of the bath requiring increased contact times to achieve a passivate film of the same thickness or color intensity as can be achieved at the higher temperatures at shorter time intervals. Typically, contact times of about 30 seconds to about 1 minute are satisfactory with contact times of about 30 seconds being usually preferred.

The operating bath can be conveniently prepared by employing a concentrate containing the active constituents with the exception of the cerium ions and oxidizing agent which is adapted to be diluted with water to which the cerium ions and oxidizing agent are separately added to form a bath containing the constituents within the desired concentration range. Similarly, replenishment of the bath on a continuous or intermittent basis can be achieved employing a concentrate of the active constituents with the exception of the cerium ions and oxidizing agent which are individually added separately to the operating bath. Typically a bath make-up concentrate can contain from about 10 to about 80 g/l chromium ions, from about 0.5 to about 50 g/l of additional metal ions of the group consisting of iron, cobalt, nickel, molybdenum, manganese, lanthanum, lanthanide mixture, or mixtures thereof, halide ions up to about 20 g/l and a suitable surfactant in an amount up to about 5 g/l if employed. Such a make-up concentrate is adapted to be diluted with about 96 volume percent water to which cerium ions and an oxidizing agent are added to produce an operating bath containing the active constituents within the ranges specified. The oxidizing agent such as hydrogen peroxide, for example, is separately introduced into the bath preferably in a form commercially available containing from about 35 to 40 percent by volume hydrogen peroxide.

As previously advised, the low solubility of cerium sulfate makes it desirable to introduce this constituent into the operating bath in the form of an aqueous acidic solution. Normally, the use of cerium sulfate in the high concentrations necessary to form a concentrate with the remaining active constituents other than the peroxide constituent causes precipitation of the cerium compound. Even when the cerium is introduced as a halide or nitrate salt, the presence of sulfate ions in the concentrate employed introduced by the other constituents causes precipitation. Accordingly, the cerium concentrate is preferably formed as a separate addition component and may comprise aqueous acidic solutions of cerous chloride or ceric sulfate having a cerium ion concentration of from about 200 to about 320 g/l and about 60 to 100 g/l, respectively. Such cerium concentrates may conveniently be comprised of the commercially available materials hereinbefore described available from Molycorp, Inc.

In order to further illustrate the present invention, the following examples are provided. It will be understood that the examples are provided for illustrative purposes and are not intended to be limiting of the scope of the invention as herein disclosed and as set forth in the subjoined claims. EXAMPLE 1

A concentrate A is prepared comprising an aqueous acidic solution containing 25 g/l trivalent chromium ions introduced as chromium sulfate (Korean MF from Allied Chemical Company), 12 g/l ammonium chloride, 12 g/l ferrous ammonium sulfate and 4% by volume of concentrated sulfuric acid.

A second aqueous acidic concentrate B is prepared containing 60 g/l tetravalent cerium ions introduced as $Ce(SO_4)_2.4H_2O$ and 5% by volume concentrated sulfuric acid.

An operating bath is prepared comprising water containing 2% by volume concentrate A, 2% by volume concentrate B and 1.5% by volume of a 38% solution of hydrogen peroxide. Electroplated zinc test panels immersed in the operating solution for 40 to 60 seconds have light-yellow iridescent passivate films on the surfaces thereof.

EXAMPLE 2

A concentrate C is prepared similar to concentrate A of Example 1 containing 25 g/l trivalent chromium ions, 20 g/l sodium chloride, 40 g/l ferric sulfate and 4% by volume concentrated sulfuric acid.

An operating bath is prepared comprising water containing 2% by volume concentrate C, 2% by volume Concentrate B of Example 1 and from 1.5–3% by volume of a 38% solution of hydrogen peroxide. Electroplated zinc test panels immersed in the operating bath produced results similar to Example 1.

EXAMPLE 3

A concentrate D is prepared similar to concentrate A of Example 1 except that 6% by volume nitric acid is employed in place of 4% sulfuric acid.

An operating bath is prepared comprising water containing 2% by volume concentrate D, 2% by volume concentrate B of Example 1 and 1.5–3% by volume of a 38% solution of hydrogen peroxide. Electroplated zinc test panels immersed in the operating bath produced results similar to Example 1.

EXAMPLE 4

A concentrate E is prepared similar to concentate C of Example 2 except that 6% by volume nitric acid is employed in place of 4% by volume sulfuric acid.

An operating bath is prepared comprising water containing 2% by volume concentrate E, 2% by volume concentrate B of Example 1 and 1.5–3% by volume of a 38% solution of hydrogen peroxide. Electroplated zinc test panels immersed in the operating bath produced results similar to Example 1.

EXAMPLE 5

A series of seven aqueous test solutions is prepared each containing 1 g/l trivalent chromium ions, 1 g/l nitric acid, 1 g/l sulfuric acid, 7 g/l hydrogen peroxide and having a nominal pH of about 1.5. To each test solution controlled additions of metal ions is made to evaluate the effect of such additions on the color, hardness and salt spray resistance of the passivate films produced on electroplated zinc test panels immersed in each test operating bath in the presence of mild agitation for a period of about 30 seconds and at a temperature of about 70° F.

The cerium ions are introduced as a $CeCl_3$ solution containing about 300 g/l cerium ions; the manganese ions are introduced as $MnSO_4.H_2O$; the ferric ions are introduced as $Fe_2(SO_4)_3$ dissolved in a dilute sulfuric acid solution; the molybdenum ions are introduced as sodium molybdate dry salt; the lanthanum ions are introduced as a $LaCl_3$ solution containing about 85 g/l lanthanum ions; and the cobalt ions are introduced as cobalt sulfate. The test solutions are designated as 5A through 5G and the concentration of metal ion additions are summarized in Table 1.

TABLE 1

| | METAL ION CONCENTRATION, g/l | | | | | | |
|---|---|---|---|---|---|---|---|
| Metal Ion | 5A | 5B | 5C | 5D | 5E | 5F | 5G |
| $Cr^{+3}$ | 1 | 1 | 1 | 1 | 1 | 1 | 1 |
| $Ce^{+3}$ | 2 | 2 | 2 | 2 | 2 | 2 | 2 |
| $Mn^{+2}$ | — | 0.9 | — | — | — | — | — |
| $Fe^{+3}$ | — | — | 0.22 | — | — | .08 | .08 |

TABLE 1-continued

| | METAL ION CONCENTRATION, g/l | | | | | | |
|---|---|---|---|---|---|---|---|
| Metal Ion | 5A | 5B | 5C | 5D | 5E | 5F | 5G |
| $Mo^{+6}$ | — | — | — | 1.0 | — | — | — |
| $La^{+3}$ | — | — | — | — | 1.0 | — | — |
| $Co^{+2}$ | — | — | — | — | — | — | 0.13 |

Each test panel after immersion in the test operating bath is water rinsed and air dried and is visually inspected for color and clarity. All of the test panels treated in solutions 5A–5G are of a substantially uniform light-yellow color varying in clarity from a clear yellow film to films which were slightly hazy or hazy as set forth in Table 2. Each test panel after air drying was immediately tested for hardness of the passivate film by a light finger rubbing. The comparative hardness test results of the passivate film on the test panels treated in test solutions 5A–5G is set forth in Table 2. It will be noted, that after a 24 hour aging of the test panels, the passivate film thereon became hard and rub resistant. The advantage of a passivate film which is hard immediately after air drying is that it can be handled for further processing without undergoing damage to the deposited film. Each test panel treated with test operating solutions 5A–5G is also subjeted to a neutral salt spray for a period of 72 hours and the surface area, expressed in terms of a percentage, in which a white corrosion deposit is formed is also tabulated in Table 2.

TABLE 2

| | TEST RESULTS | | |
|---|---|---|---|
| TEST SAMPLE | CLARITY | HARDNESS | NEUTRAL SALT SPRAY, 72 Hrs. - % White Corrosion |
| 5A | Sl. Haze | Soft | 50 |
| 5B | Sl. Haze | Soft | 100 |
| 5C | Sl. Haze | Hard | 10 |
| 5D | Haze | Hard | 0 |
| 5E | Sl. Haze | Soft | 100 |
| 5F | Clear | Soft | 2 |
| 5G | Clear | Hard | 0 |

Based on the data as set forth in Table 2, from a clarity and hardness evaluation, test sample 5G is a definite pass, test samples 5C and 5F are acceptable, while test samples 5A, 5B and 5E are less acceptable based on general appearance. From the standpoint of corrosion resistance, test samples 5D, 5F and 5G are definite passes, 5C is a marginal pass, while test samples 5A, 5B and 5E are considered not acceptable based on ASTM corrosion standard specifications for a 72 hour neutral salt spray evaluation. It should be pointed out, however, that each of the test samples possess improved corrosion resistance in comparison to an untreated electroplated zinc test panel and the passivate films which failed the 72 hour neutral salt spray test are nevertheless acceptable for less rigorous service exposures. The corrosion resistance provided by the test solution 5G is substantially comparable to that attainable with conventional prior art hexavalent chromium passivate solutions of the types heretofore known. It will also be appreciated that variations in the types, combinations and concentrations of the metal ions contained in the test solutions can be made to optimize and improve the clarity, hardness and corrosion resistance of the test panels over the results as set forth in Table 2. The selection of a 72 hour neutral salt spray condition is relatively severe and is generally employed for parts subjected to exterior exposure such as in automotive components. The 72 hour neutral salt spray test is normally applied to yellow hexavalent chromium passivates although some specifications require only 48 hours while others require a 96 hour exposure. The 72 hour test period was, accordingly, selected as being of average severity.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic solution for treating receptive metal substrates to impart a chromate passivate film thereon comprising chromium ions substantially all of which are in the trivalent state, an acid, a solution compatible peroxide or persulfate oxidizing agent, and cerium ions present in an effective amount to impart increased corrosion resistance to the treated substrate.

2. The aqueous solution as defined in claim 1 in which the trivalent chromium ions are present in an amount of about 0.05 g/l up to saturation.

3. The aqueous acidic solution as defined in claim 1 in which the trivalent chromium ions are present in an amount of about 0.2 to about 2 g/l.

4. The aqueous solution as defined in claim 1 in which the trivalent chromium ions are present in an amount of about 0.5 to 1 g/l.

5. The aqueous solution as defined in claim 1 having a pH of about 1.2 to about 2.5.

6. The aqueous solution as defined in claim 1 having a pH of about 1.5 to about 2.0.

7. The aqueous solution as defined in claim 1 in which said acid is a mineral acid selected from the group consisting of sulfuric, nitric, hydrochloric and mixtures thereof.

8. The aqueous solution as defined in claim 1 in which said oxidizing agent is present in an amount of about 1 to about 20 g/l calculated on a weight equivalent effectiveness basis to hydrogen peroxide.

9. The aqueous solution as defined in claim 1 in which said oxidizing agent is present in an amount of about 3 to about 7 g/l calculated on a weight equivalent effectiveness basis to hydrogen peroxide.

10. The aqueous solution as defined in claim 1 in which said oxidizing agent comprises a peroxide.

11. The aqueous solution as defined in claim 1 in which said oxidizing agent comprises hydrogen peroxide.

12. The aqueous solution as defined in claim 1 further containing sulfate ions in an amount up to about 15 g/l.

13. The aqueous solution as defined in claim 1 further containing sulfate ions in an amount of about 0.5 to about 5 g/l.

14. The aqueous solution as defined in claim 1 further containing at least one additional metal ion selected from the group consisting of iron, cobalt, nickel, molybdenum, manganese, lanthanum, lanthanide mixture as well as mixtures thereof.

15. The aqueous solution as defined in claim 14 in which said one additional metal ion comprises iron.

16. The aqueous solution as defined in claim 14 in which said one additional metal ion comprises cobalt.

17. The aqueous solution as defined in claim 14 in which said one additional metal ion comprises nickel.

18. The aqueous solution as defined in claim 14 in which said one additional metal ion comprises molybdenum.

19. The aqueous solution as defined in claim 14 in which said one additional metal ion comprises manganese.

20. The aqueous solution as defined in claim 14 in which said one additional metal ion comprises lanthanum.

21. The aqueous solution as defined in claim 14 in which said one additional metal ion comprises a lanthanide mixture comprised predominantly of lanthanum compounds.

22. The aqueous solution as defined in claim 14 in which said one additional metal ion and mixtures thereof is present in an amount up to about 1 g/l.

23. The aqueous solution as defined in claim 14 in which said one additional metal ion or mixtures thereof is present in an amount of about 0.1 to about 0.2 g/l.

24. The aqueous solution as defined in claim 1 in which said cerium ions are present in an amount of about 0.5 to about 10 g/l.

25. The aqueous solution as defined in claim 1 in which said cerium ions are present in an amount of about 1.0 to about 4 g/l.

26. The aqueous solution as defined in claim 1 further including halide ions.

27. The aqueous solution as defined in claim 26 in which said halide ions are present in an amount up to about 8 g/l.

28. The aqueous solution as defined in claim 26 in which said halide ions are present in an amount of about 0.1 to about 2.5 g/l.

29. The aqueous solution as defined in claim 1 further including a surfactant.

30. The aqueous solution as defined in claim 29 in which said surfactant is present in an amount up to about 1 g/l.

31. The aqueous solution as defined in claim 29 in which said surfactant is present in an amount of about 50 to about 100 mg/l.

32. A process for treating a receptive metal substrate to impart a chromate passivate film thereon which comprises the steps of compacting the substrate with a solution at a temperature of about 40° to about 150° F. having a composition of claim 1 or 2 or 3 or 4 or 5 or 6 or 7 or 8 or 9 or 10 or 11 or 12 or 13 or 14 or 15 or 16 or 17 or 18 or 19 or 20 or 21 or 22 or 23 or 24 or 25 or 26 or 27 or 28 or 29 or 30 or 31 for a period of time sufficient to form a passivate film thereon.

* * * * *